US009488326B2

(12) United States Patent
Allen et al.

(10) Patent No.: US 9,488,326 B2
(45) Date of Patent: Nov. 8, 2016

(54) BATTERY POWERED INDOOR/OUTDOOR DECORATIVE TABLE AND FLOOR LAMP AND LED BASED LIGHT BULB

(71) Applicant: Linda Allen, Los Angeles, CA (US)

(72) Inventors: Linda Allen, Las Vegas, NV (US); David Glenn Glover, Agua Dulce, CA (US)

(73) Assignee: Linda Allen, Las Vegas, NV (US)

( * ) Notice: Subject to any disclaimer, the term of this patent is extended or adjusted under 35 U.S.C. 154(b) by 0 days.

(21) Appl. No.: 14/679,758

(22) Filed: Apr. 6, 2015

(65) Prior Publication Data

US 2015/0211700 A1 Jul. 30, 2015

Related U.S. Application Data

(63) Continuation of application No. 12/890,164, filed on Sep. 24, 2010, now abandoned.

(60) Provisional application No. 61/246,296, filed on Sep. 28, 2009, provisional application No. 61/246,297, filed on Sep. 28, 2009, provisional application No. 61/246,304, filed on Sep. 28, 2009.

(51) Int. Cl.
*F21L 4/00* (2006.01)
*F21S 9/02* (2006.01)
(Continued)

(52) U.S. Cl.
CPC ..... *F21S 9/02* (2013.01); *F21K 9/135* (2013.01); *F21S 6/00* (2013.01); *F21S 6/002* (2013.01); *F21S 6/005* (2013.01); *F21V 3/00* (2013.01); *F21V 21/06* (2013.01); *F21V 31/005* (2013.01);
(Continued)

(58) Field of Classification Search
CPC ..... F21Y 2111/007; F21W 2131/10; F21W 2131/40; F21K 9/135; F21L 4/00; F21S 6/00; F21S 6/002
USPC ..... 362/190, 191, 800, 183, 230–235
See application file for complete search history.

(56) References Cited

U.S. PATENT DOCUMENTS 5,271,594 A 12/1993 Djelouah
6,082,877 A 7/2000 Hughes
(Continued)

FOREIGN PATENT DOCUMENTS

WO 0184042 11/2001

OTHER PUBLICATIONS

International Search Report; PCT/US2010/050426; Feb. 8, 2011.
(Continued)

*Primary Examiner* — Karabi Guharay
*Assistant Examiner* — Jessica M Apenteng
(74) *Attorney, Agent, or Firm* — Stetina Brunda Garred & Brucker

(57) ABSTRACT

Provided is a lamp configured for both indoor use and outdoor use. The lamp may include several features to protect against conditions encountered during outdoor use, such as wind, precipitation, lack of external power, etc. The lamp also defines an aesthetically pleasing design to provide lighting during upscale outdoor events/celebrations, such as weddings, reunions, holiday events, or a private gathering in a backyard. The functional and aesthetic features of the lamp, such as the lamp's capability of operating independent of a power cord while at the same time defining a stylish appearance, may additionally make the lamp desirable for use in indoor environments.

1 Claim, 5 Drawing Sheets

(51) Int. Cl.

| | |
|---|---|
| ***F21S 6/00*** | (2006.01) |
| ***F21V 3/00*** | (2015.01) |
| ***F21V 21/06*** | (2006.01) |
| ***F21V 31/00*** | (2006.01) |
| ***F21K 99/00*** | (2016.01) |
| *F21V 1/16* | (2006.01) |
| *F21Y 101/02* | (2006.01) |
| *F21Y 111/00* | (2016.01) |
| *F21W 131/10* | (2006.01) |
| *F21W 131/40* | (2006.01) |

(52) U.S. Cl.

CPC .. *F21L 4/00* (2013.01); *F21V 1/16* (2013.01); *F21W 2131/10* (2013.01); *F21W 2131/40* (2013.01); *F21Y 2101/02* (2013.01); *F21Y 2111/005* (2013.01); *F21Y 2111/007* (2013.01)

(56) References Cited

U.S. PATENT DOCUMENTS

| | | | | |
|---|---|---|---|---|
| 6,422,717 | B1 | 7/2002 | Beadle | |
| 6,484,456 | B1 | 11/2002 | Featherstone et al. | |
| 6,567,248 | B1 | 5/2003 | Schmidt et al. | |
| 6,942,361 | B1 | 9/2005 | Kishimura et al. | |
| 7,252,414 | B2 | 8/2007 | Chabert | |
| 7,309,141 | B2 * | 12/2007 | Scott | B60Q 1/26 200/61.22 |
| 2002/0145863 | A1 * | 10/2002 | Stultz | F21S 9/02 362/96 |
| 2007/0091594 | A1 * | 4/2007 | Soon | F21L 4/00 362/183 |
| 2007/0115663 | A1 | 5/2007 | Weiser et al. | |
| 2007/0121319 | A1 * | 5/2007 | Wolf | A01M 1/2083 362/231 |
| 2007/0183143 | A1 | 8/2007 | Allsop et al. | |
| 2009/0040750 | A1 | 2/2009 | Myer | |

OTHER PUBLICATIONS

Extended European Search Report; PCT/US2010050426; Feb. 18, 2014.

* cited by examiner

BATTERY POWERED INDOOR/OUTDOOR DECORATIVE TABLE AND FLOOR LAMP AND LED BASED LIGHT BULB

CROSS-REFERENCE TO RELATED APPLICATIONS

This application is a continuation application of U.S. patent application Ser. No. 12/890,164, filed Sep. 24, 2010, which claims the benefit of U.S. Provisional Application No. 61/246,296, filed Sep. 28, 2009, U.S. Provisional Application No. 61/246,297, filed Sep. 28, 2009, and U.S. Provisional Application No. 61/246,304, filed Sep. 28, 2009.

STATEMENT RE: FEDERALLY SPONSORED RESEARCH/DEVELOPMENT

Not Applicable

BACKGROUND OF THE INVENTION

1. Field of the Invention

The present invention relates generally to lamps and light bulbs for lamps. More particularly, the present invention is directed to an indoor/outdoor lamp, which may be battery powered. Additional aspects of the present invention relate to an LED-based light bulb.

2. Description of the Related Art

Lamps are widely used to provide light to dark areas. Lamps typically include a base for placing the lamp on a support surface, such as the floor or table. Most lamps further include a lamp body extending from the base, wherein the lamp body comprises a socket configured to receive a light bulb. In general, lamps include a power cord to receive power from an external power source, such as an electrical outlet on a wall, to light up a light bulb connected to the socket.

In addition to serving the basic utilitarian need of providing light, lamps may also be designed to be aesthetically appealing. For instance, the lamp base and lamp body may define aesthetically pleasing sizes, shapes and colors. Furthermore, the lamp shades may also contribute to the overall aesthetic appeal of the lamp.

Lamp usage is typically limited to indoor usage for a variety of reasons. One reason is that lamps generally are not configured to withstand the elements which may be encountered during outdoor use. For instance, precipitation may damage the body/base of the lamp, as well as the lamp shade. Precipitation may also create wetness, which may cause an electrical shortage in the wiring of the lamp. Wind may also present a problem for outdoor lamp usage, as a gust of wind may cause the lamp to fall over, resulting in possible damage to the lamp.

Another reason that lamps are typically limited to indoor use is that operation of the lamp is generally dependent upon power from an external power source. In this regard, indoor lamp usage allows a lamp to receive power from a power outlet disposed in a wall via a power chord. For instance, most indoor lamps operate on 120 VAC, which poses a life threatening shock hazard, especially in wet outdoor locations. Furthermore, the power chord may be a tripping hazard. Accordingly, usage of a lamp in a remote outdoor location is typically unattainable because of the dependency of power from external power sources.

In addition to the above-described deficiencies associated with the lamps, conventional light bulbs used with the lamps also suffer from their own deficiencies. Incandescent light bulbs are traditionally used in light fixtures and lamps, and operate by passing an electric current through a thin filament, heating it to a temperature which produces light. Incandescent light bulbs provide a sufficient amount of light, yet they tend to be inefficient from an energy standpoint and may undesirably emit large amounts of heat. Indeed, in the United States, laws have been drafted to encourage phasing out of incandescent light bulbs The present disclosure addresses and overcomes the above-noted deficiencies by providing a battery powered lamp sized and configured for indoor and outdoor usage. The present disclosure further relates to an improved light emitting diode (LED) based light bulb which is more efficient than conventional incandescent light bulbs. These and other advantages attendant to the present invention will be described in more detail below.

BRIEF SUMMARY OF THE INVENTION

In accordance with the present invention, there is provided a decorative table/floor lamp configured for both indoor use and outdoor use. The lamp may include several features to protect against conditions encountered during outdoor use, such as wind, precipitation, lack of external power, etc. The lamp also defines an aesthetically pleasing design to provide lighting during upscale outdoor events/celebrations, such as weddings, reunions, holiday events, a private gathering in a backyard, or in wet areas, such as by a pool, ocean or lake. In this regard, the decorative table/floor lamp is a decorative alternative to conventional propane powered lanterns, or candles, which were commonly used to provide lighting outside.

According to one embodiment, the lamp includes a lamp body and a lamp base coupled to the lamp body. The lamp base includes a base housing defining an inner cavity. A battery is disposed within the inner cavity to power the lamp so the lamp is not dependent upon power from external resources. The lamp base is sized and configured to mitigate pivotal movement of the lamp relative to the supper surface (i.e., tipping) in wind up to 30 MPH.

According to another implementation of the present invention, there is also provided a light emitting diode (LED) based light bulb including a unitary light structure having a base and a stem extending from the base. The stem is mounted with a plurality of light emitting diodes operative to produce a color temperature of between 2,700 to 3,000 K. The LED-based light bulb is a desirable alternative to conventional incandescent light bulbs because it provides greater illumination and utilizes less power than prior art light bulbs. Furthermore, the LED-based light bulb is rated for outdoor use making it desirable for use with the above-described lamp.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

Common reference numerals are used throughout the drawings and detailed description to indicate like elements.

DETAILED DESCRIPTION OF THE INVENTION

Figure 1:
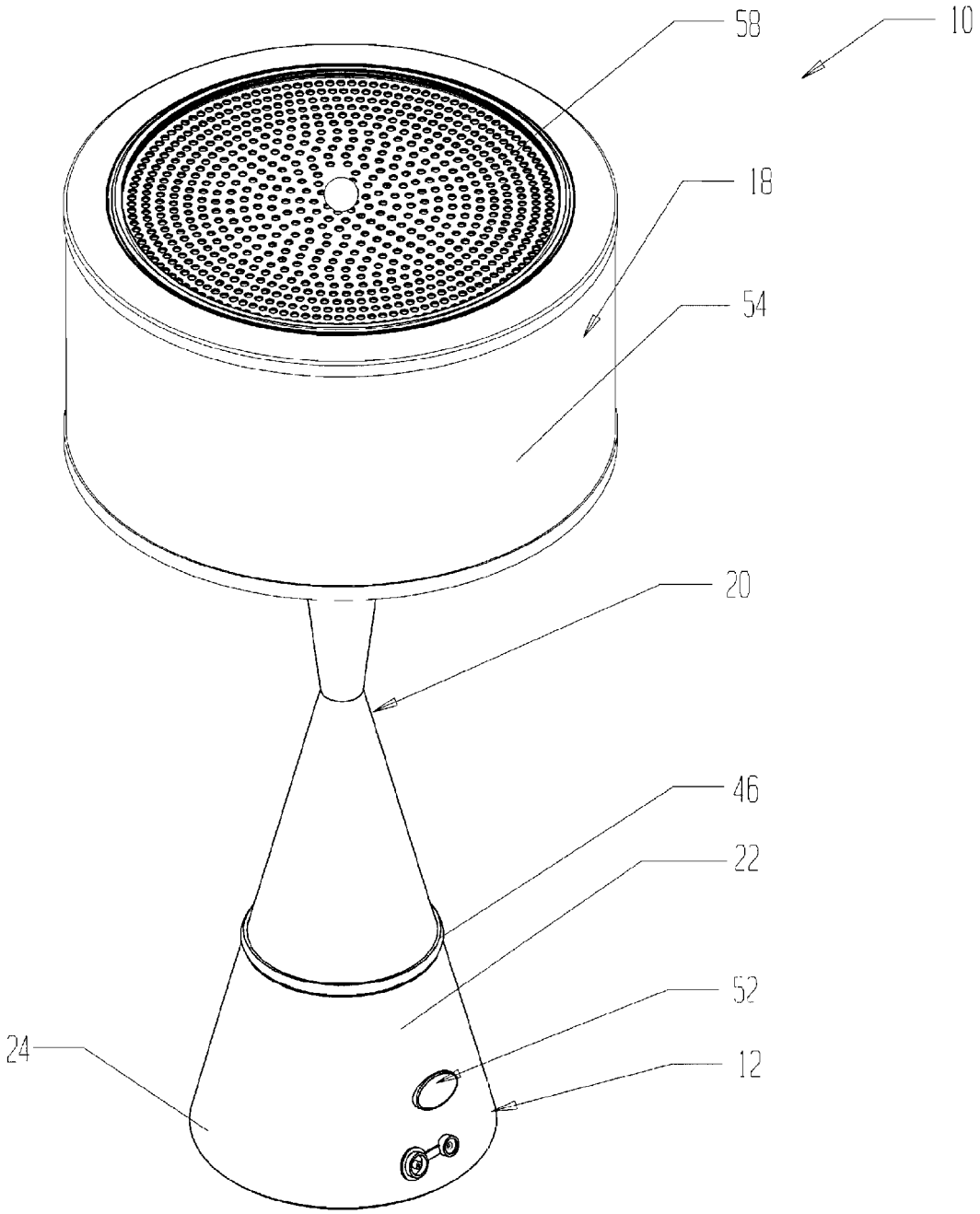
FIG. 1 is a upper perspective view of a lamp constructed in accordance with an embodiment of the present invention.

Referring now to the drawings wherein the showings are for the purposes of illustrating a preferred embodiment of the present invention only, and not for purposes of limiting the same, FIGS. 1-4 depict a lamp 10 constructed in accordance with an embodiment of the present invention. The lamp 10 is specifically configured for both indoor and outdoor use. In this regard, the lamp 10 is constructed to withstand and endure exposure to the outer elements, while at the same time having an aesthetically appealing design. Furthermore, there is also provided an LED (light emitting diode) based light bulb 110, which provides greater illumination and utilizes less power than conventional incandescent light bulbs.

As will be described in more detail below, the lamp 10 includes several features which enable use both inside and outside. One feature relates to a weighted base 12 or lower portion of the lamp 10 which allows the lamp 10 to withstand gusts of wind. Another feature relates to the battery(s) 15, 17 (see FIG. 4) which powers the lamp 10 and allows the lamp 10 to be used in remote outdoor locations which may not have access to other power sources. The lamp 10 also includes a water resistant cavity 16 (see FIGS. 2 and 4) within which the batteries 15, 17 is stored. A 12 volt E26 socket LED based light bulb 110 may be used with the lamp 10 to operate at higher efficiency (i.e., requires less power to enable longer use before the batteries 15, 17 requires recharging). The lamp 10 may further include a weather resistant coating to protect the lamp 10 from precipitation and to endure temperature extremes (extremely hot temperatures as well as extremely cold temperatures). The lamp shade 18 may also be formed from a weather resistant material to allow the lamp shade 18 to withstand the elements outside.

The lamp 10 includes a lamp body 20 and a lamp base 12 connected to the lamp body 20. The lamp base 12 defines an upper end portion 22 and an opposing lower end portion 24. The upper end portion 22 is disposed adjacent the lamp body 20 and the lower end portion 24 is disposed on a support surface, such as a table, floor or the like. The lamp base 12 includes a base wall 26 defining a base cavity 16 sized to receive the batteries 15, 17 and related components, as described in more detail below. A lamp base cover 28 is connected to the base wall 26 to contain the components housed therein. When the cover 28 is removed, access to the base cavity 16 (i.e., to access the batteries 15, 17) is provided. The lamp base cover 28 may be weighted and formed from a dense material to mitigate tipping or falling of the lamp 10. It is understood that when the lamp 10 is placed outside during use, it is subject to the weather conditions, including wind. Therefore, the weighted lamp base cover 28 may allow the lamp to withstand gusts of wind up to 30 MPH without tipping or falling from a generally horizontal surface. Although the lamp base cover 28 is weighted to mitigate tipping of the lamp, the overall weight of the lamp 10 is light enough to enable carrying of the lamp by a single individual.

In addition to a weighted lamp base cover 28, the configuration of the base wall 26 may also mitigate tipping of the lamp 10. In the specific configuration depicted in the figures, the base wall 26 defines a generally frustoconical shape, wherein the lamp base 12 defines a diameter that increases from the upper end portion 22 toward the lower end portion 24. The increased diameter of the lower end portion 24 reduces the tendency that the lamp 10 will tip in a gust of wind.

It is contemplated that other embodiments of the lamp 10 may include a lamp base 12 that does not define a frustoconical shape without departing from the spirit and scope of the present invention. Along these lines, the lamp base 12 preferably defines a shape that is wider adjacent the lower end portion 24 than the upper end portion 22. Lamp base configurations which deviate from such a shape may include weights disposed within the base cavity 16 adjacent the lower end portion 24 to compensate for a shape which may not mitigate tipping.

The lamp body 20 includes an aesthetically pleasing design that may compliment the design of the lamp base 12. In the embodiment depicted in the drawings, the lamp body 20 includes a body wall 30 (see FIGS. 2 and 4) defining a frustoconical lower portion 32 (see FIGS. 2 and 4) and an inverted frustoconincal upper portion 34 (see FIGS. 2 and 4). The lower end of the frustoconical lower portion 32 is complimentary to the lamp base 12 to give the appearance of a seamless transition between the lamp base 12 and the lamp body 20.

The lamp body 20 includes a body cavity 36 (see FIGS. 2 and 4) including an inner lamp conduit 38 extending therethrough. Wiring may extend through the conduit 38 between the batteries 15, 17 and the lamp socket 40 (see FIGS. 2 and 4) to transfer power to the light bulb 110. In this regard, the conduit 38 includes a hollow passage 42 (see FIGS. 2 and 4) which contains the wiring.

The conduit 38 may also interconnect the lamp base 12 to the lamp body 20. The lamp base 12 includes a base conduit opening disposed adjacent the upper end portion 22 thereof, while the lamp body 20 includes a lower body conduit opening disposed adjacent the lower end portion thereof. The base conduit opening and the lower body conduit opening are coaxially aligned with each other to allow the conduit 38 to extend therethrough and into the base cavity 16. The end of the conduit extending into the base cavity 16 may include a threaded portion to allow the conduit 38 to engage with a mechanical fastener, such as a nut, to secure the lamp base 12 to the lamp body 20.

The lamp 10 may further include a band 46 or strip disposed between the lamp base 12 and lamp body 20 to add to the overall aesthetic appeal to the lamp 10. The band 46 may conceal the joint between the lamp base 12 and the lamp body 20 to create the appearance of a uniform structure. In certain embodiments, the band 46 may also provide a water resistant barrier between the lamp base 12 and lamp body 20 to protect against moisture seeping into the base cavity 16 or body cavity 36 through the base conduit opening or lower body conduit opening. To this end, the band 46 may be formed from aluminum or other materials known in the lamp industries connected with silicone or rubber gaskets to create a water resistant barrier. The band 46 may be compressed between the lamp body 20 and lamp base 12 when the nut 44 is tightened onto the conduit 38.

Figure 2:
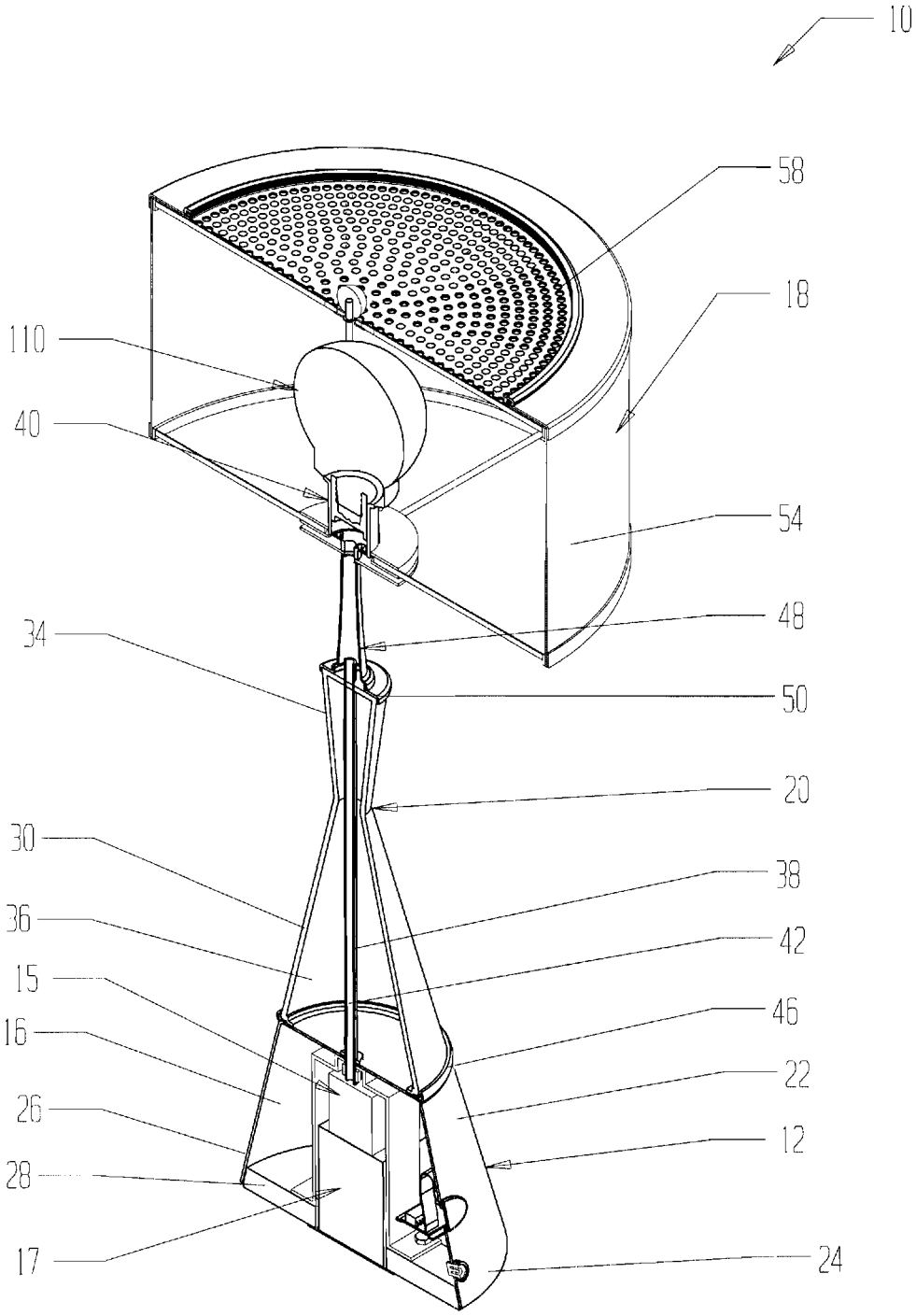
FIG. 2 is an upper perspective sectional view of the lamp depicted in FIG. 1.
Figure 3:
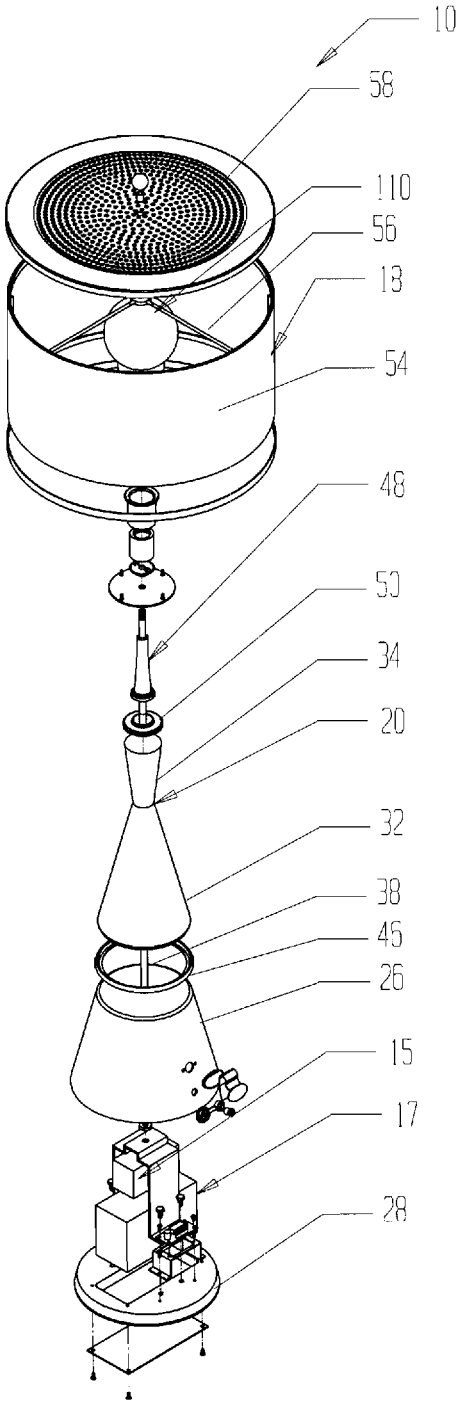
FIG. 3 is an exploded view of the lamp depicted in FIGS. 1 and 2.
Figure 4:
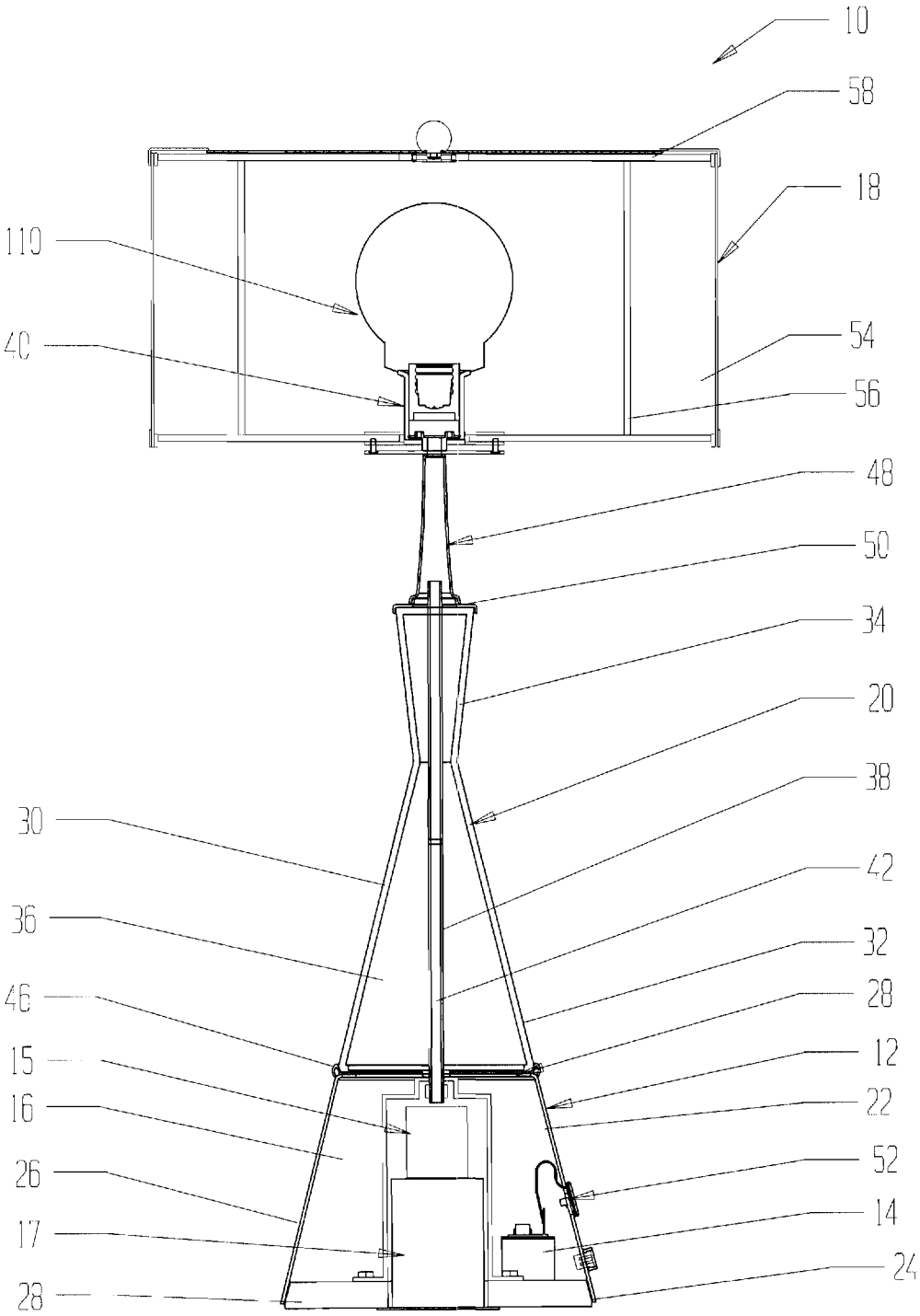
FIG. 4 is a side sectional view of the lamp depicted in FIGS. 1-3.

Referring now to FIGS. 2-4, a lamp stem 48 may extend between the lamp body 20 and the lamp shade 18. As shown in the drawings, an upper end cap 50 is disposed at the upper end portion of the lamp body 20. The upper end cap 50 may be configured to be threadably engageable or frictionally engageable with the lamp stem 48 to secure the lamp stem 48 to the lamp body 20. The upper end cap 50 includes an opening which the conduit 38 extends through. The lamp stem 48 is hollow to allow the wiring to continue from the conduit 38 through the lamp stem 48.

A socket 40 is connected to the lamp stem 48 opposite the lamp body 20. The socket 40 may include a standard connector for mating with a light bulb 110. The wiring from the batteries 15, 17 extends to the socket 40 to provide power to the socket 40, and ultimately, to the light bulb 110 engaged with the socket 40. A socket protector or rubber boot may be connected to the socket 40 for keeping the socket fluid tight.

As previously mentioned, one embodiment of the lamp 10 include a batteries 15, 17 to allow the lamp 10 to be operational in a location remote from an external power source. The batteries 15, 17 may be wired in parallel to give the lamp a longer lamp life. The batteries 15, 17 are disposed within the lamp base cavity 16 to provide easy access to the batteries 15, 17, and to add to the weight of the base 12 of the lamp 10 to further mitigate tipping of the lamp 10. A battery bracket 14 may be used to secure the batteries 15, 17 within the base 12. The batteries 15, 17 are preferably rechargeable 12V batteries, although other batteries known in the art may also be used without departing from the spirit and scope of the present invention. The batteries 15, 17 may be in electrical communication with a charging plug 52 disposed within the base wall 26 to allow a user to connect a recharging cable to the batteries 15, 17. The recharging cable may be connected to a wall outlet, or other power source, to recharge the batteries 15, 17. A waterproof rubber cap may be disposed about the charging plug 52 to create a fluid tight seal between the charging plug 52 and the base wall 26.

The lamp base 12 may include a battery support for supporting the batteries 15, 17 within the lamp base 12. In addition to providing a structural support to the batteries 15, 17, the battery support may be configured to provide ventilation to the batteries 15, 17, as well as insulate the batteries 15, 17 from extreme heat or cold. One embodiment of the battery support includes a layer of insulating foam disposed between an upper grill and a lower grill to provide ventilation. The above-described battery support is exemplary in nature only; it is understood that other battery supports may be used without departing from the spirit and scope of the present invention.

By disposing the batteries 15, 17 within the water resistant cavity 16, the batteries 15, 17 is protected from wetness from precipitation. In this regard, the lamp 10 may be disposed outside without worry that a surprise storm may damage the batteries 15, 17. Furthermore, the batteries 15, 17 allows the lamp 10 to be used in remote areas where other external power sources are not readily available, such as at a beach, on a mountain, on a boat, or even a remote area of the user's property.

The lamp 10 may include circuitry (i.e., a circuit board) for controlling the brightness of the light emitted by the lamp 10. For instance, the lamp 10 may have several dimming settings, such as high, medium, and low, to provide light at different brightness levels. The circuitry may additionally be configured to automatically turn off the lamp 10 when the power in the batteries 15, 17 is low.

As an alternative to a battery powered lamp, the lamp 10 may include a power cord which plugs into an external power source, such as an outlet on a wall. It is contemplated that such a lamp 10 may be used inside, or on a deck, porch, or patio, where a wall outlet is readily accessible. The cord is preferably 8-10 feet in length; however, those skilled in the art will appreciate that the cord may define other lengths. The cord is additionally outdoor rated to endure long exposure outside.

Various components of the lamp 10 may be coated with one or more coatings to mitigate damage caused by extensive use outside. Along these lines, the external surfaces of the lamp 10 may be coated with a primer for corrosive resistance. Urethane paint is then applied to the surfaces, in addition to a sealer to provide further protection for outdoor use. The paint is preferably a polyurethane low voc paint.

A lamp shade 18 may be connected to the lamp body 20 to soften the light emitted thereby. The lamp shade 18 includes shade body 54 and a harp 56 connected the shade body 54 and the lamp body 20. The shade body 54 is preferably formed from an outdoor rated fabric to enable the lamp shade 18 to withstand the outside environment. The harp 56 is preferably powder coated to configure the harp 56 for outside use. In a preferred embodiment, the lamp shade 18 includes a UV clear plastic lining with a laminated outdoor rated weather resistant UV rated fabric that diffuses the light from the sides of the lamp shade 18. The adhesive/glue that seals the plastic to the lamp shade 18 is weather resistant. The harp 56 is plated with a top coat of polyurethane or powder coated to protect against the weather.

The shade body 54 may define a variety of shapes and sizes. In the embodiment depicted in the figures, the shade body 54 is generally cylindrical in nature; although it is understood that the depicted shade body 54 is exemplary in nature only, and the present invention is not limited thereto. A perforated, stainless steel diffuser 58 may be disposed adjacent an upper end portion of the shade body 54. The diffuser 58 is preferably formed from aluminum and is plated with a top coat of polyurethane, or powder coated to protect the diffuser 58 from the outer elements, while still allowing diffused light.

Figure 5:
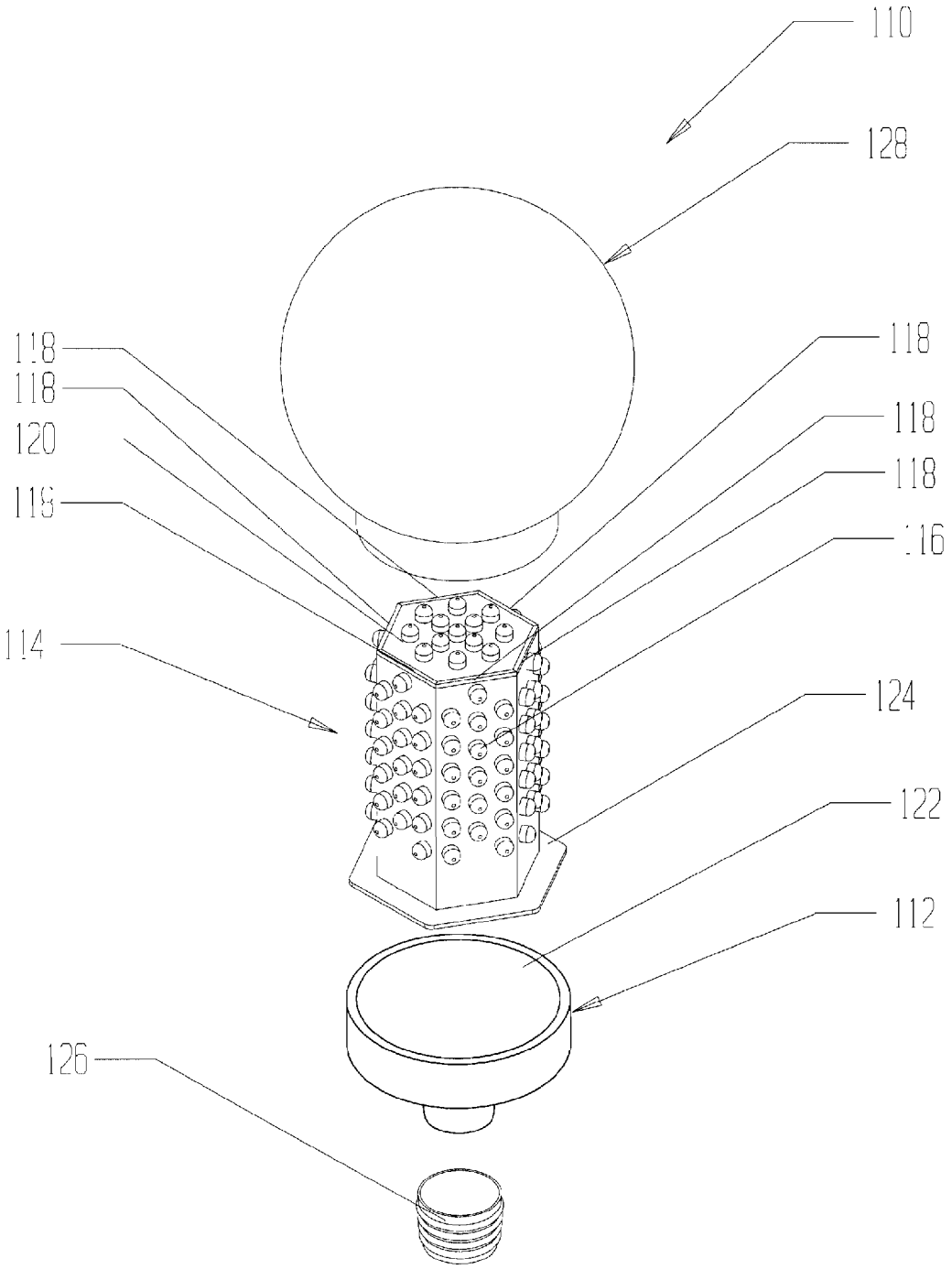
FIG. 5 is an upper perspective exploded view of an LED-based light bulb constructed in accordance with an embodiment of the present invention.

A light bulb 110 is connected to the socket 40 to receive power from the lamp 10 to illuminate the adjacent areas. According to one embodiment, and referring now specifically to FIG. 5, the light bulb 110 is an improved LED-based light bulb that can be utilized in indoor and outdoor applications and is operative to fit via conventional light sockets 40. The improved LED-based light bulb 110 provides greater illumination and utilizes less power than conventional incandescent light bulbs. It is recommended that the LED-based light bulb 110 be used with the lamp 10 described above; however, those skilled in the art will appreciate that other light bulbs may be used without departing from the spirit and scope of the present invention.

Generally, the properties of the improved LED-based light bulb 110 are generally as follows: approximately 8 watt, 12 volt, outdoor rated LED light bulb with lamp base med (E26) socket—color: warm light (2700-3000 Kelvin temp). According to one implementation, the color rendering for the lamp is above 80 CRI. The specifications further include a vertical mounting configuration, inside a diffused shroud to imitate an incandescent light bulb equivalent to approximately 55-60 watts of light. The foregoing specifications are exemplary in nature only and are not intended to limit the scope of the LED-based light bulb 110.

The LED-based light bulb 110 includes a base 112 and a stem 114 coupled to the base 112. A plurality of LEDs 116 are mounted to the stem 114 in spaced relation to each other. In the embodiment depicted in FIG. 5, the stem 114 includes a plurality of longitudinal faces 118 and an end face 120, with LEDs 116 mounted to each longitudinal face 118 and the end face 120 to provide illumination in several directions.

The depicted stem 114 defines a hexagonal transverse cross-section, thereby defining six longitudinal faces 118. However, those skilled in the art will appreciate that fewer than six or more than six longitudinal faces 118 may be defined by the stem 114 without departing from the spirit and scope of the present invention. In fact, the stem 114 may define various shapes and sizes, such as spherical, semi-spherical, frustoconical, cubical, etc. without departing from the spirit and scope of the present invention.

The number of LEDs 116 mounted to the stem 114 may also be varied. Fewer LEDs 116 may be mounted for soft or dim lighting applications, while more LEDs 116 may be mounted for brighter applications. However, the stem preferably includes 120 LEDs 116 mounted thereto.

The stem 114 is configured to be received within a cavity 122 formed within the base 112. Along these lines, a flange 124 may extend radially outward from the stem 114 to engage with the base 112 to secure the stem 114 thereto.

The base 112 may be connected to an electrical connector 126 sized to be threadably engageable with a conventional electrical socket. Wiring may extend between the electrical connector 126 and the LEDs 116 to electrically communicate power from the electrical connector to the LEDs 116.

An enclosure element 128, such as a glass, plastic, or polycarbonate globe, may be connected to the base 112 to enclose the stem 114 and LEDs 116. The size and shape of the enclosure element 128 may vary according to the size and shape of the stem 114. Furthermore, the enclosure element 128 may be formed in various colors to alter the color emitted by the lamp.

The LED-based light bulb 110 provides a desirable alternative to conventional incandescent light bulbs because it provides greater illumination and utilizes less power than prior art light bulbs. Along these lines, the light bulb 110 is approximately an 8 watt light bulb which gives approximately 540 lumen output (which is equivalent to 55-60 watts of light) of "reading light" at night, which is unique for a "decorative outdoor portable" fixture. Furthermore, the LED-based light bulb 110 is rated for outdoor use making it desirable for use with the above-described lamp 10.

This disclosure provides an exemplary embodiment of the present invention. The scope of the present invention is not limited by this exemplary embodiment. Numerous variations, whether explicitly provided for by the specification or implied by the specification, such as variations in structure, dimension, type of material and manufacturing process may be implemented by one of skill in the art in view of this disclosure.

What is claimed is:

1. A battery powered indoor/outdoor lamp disposable on a support surface and useable with a light element, the lamp comprising:

a lamp body;

a lamp base rigidly affixed to the lamp body, the lamp base including:

a base housing including a frustoconical base wall defining an inner cavity;

a battery disposed within the inner cavity; and a first grill coupled to the base housing and disposed in abutting contact with the battery, the first grill being configured to enable fluid flow therethrough;

wherein the lamp base is sized and configured such that when disposed upon, but not attached to, the support surface, the lamp base effectively mitigates a pivotal movement of the lamp relative to the support surface in wind up to 30 MPH;

a lamp shade coupled to the lamp body, the lamp shade being fabricated from an outdoor rated fabric;

a gasket positioned between the lamp base and the lamp body and configured to provide a water-tight interconnection therebetween;

a socket coupled to the lamp body and configured to be engageable with a light element external to the lamp body;

a light bulb including a plurality of LEDs, coupled to the lamp body and external to the lamp body; and wherein the lamp body includes a body wall defining a first frustoconical section complimentary to the frustoconical base wall, and a second frustoconical section extending from the first frustoconical section, the first frustoconical section having a decreasing diameter in a direction extending away from the lamp base, the second frustoconical section having an increasing diameter in the direction extending away from the lamp base.

* * * * *